US005087135A

United States Patent [19]

Tew et al.

[11] Patent Number: 5,087,135

[45] Date of Patent: Feb. 11, 1992

[54] PRINTER PAPER THICKNESS DETECTOR

[75] Inventors: Nicholas H. Tew, Newbury Park; Lyudmila M. Preys, Granada Hills, both of Calif.

[73] Assignee: DataProducts Corporation, Woodland Hills, Calif.

[21] Appl. No.: 181,537

[22] Filed: Apr. 14, 1988

[51] Int. Cl.[5] ..... B41J 11/20; B41J 25/308

[52] U.S. Cl. ..... 400/56; 400/55

[58] Field of Search ..... 400/56, 57, 157.3, 55-59, 400/624, 625, 629

[56] References Cited

U.S. PATENT DOCUMENTS

| | | | |
|---|---|---|---|
| 3,990,560 | 11/1976 | Pavliscak et al. | 400/56 |
| 4,088,215 | 5/1978 | Bader | 400/56 |
| 4,173,927 | 11/1979 | Van Kempen et al. | 400/56 X |
| 4,652,153 | 3/1987 | Kotsuzumi et al. | 400/56 |
| 4,656,400 | 4/1987 | Pailthorp et al. | 318/135 |
| 4,676,675 | 6/1987 | Suzuki et al. | 400/56 |

FOREIGN PATENT DOCUMENTS

| | | | |
|---|---|---|---|
| 195981 | 10/1986 | European Pat. Off. | 400/56 |
| 0118315 | 10/1978 | Japan | 400/56 |
| 96868 | 6/1982 | Japan | 400/59 |
| 0059878 | 4/1983 | Japan | 400/56 |
| 128882 | 8/1983 | Japan | 400/56 |
| 0128882 | 8/1983 | Japan | 400/56 |
| 270177 | 11/1986 | Japan | 400/56 |

*Primary Examiner*—David A. Wiecking
*Assistant Examiner*—Steven S. Kelley
*Attorney, Agent, or Firm*—Spensley, Horn, Jubas & Lubitz

[57] ABSTRACT

A printer having a printing mechanism for placing printed matter on a substrate, the printing mechanism including character printing elements and an electrically driven hammer unit which is connected to receive an actuating current and is operative for causing the printing elements to print characters on the substrate by impacting against the elements with an impact force dependent on the magnitude of the actuating current, the printer being further provided with: a substrate thickness monitoring device mounted in the printer for monitoring the thickness of a substrate disposed to be printed upon by the mechanism and for producing an electrical output signal indicative of the substrate thickness within a predetermined amount of time; and an actuating current control circuit connected to receive the output signal from the monitoring device and to control the actuating current in a manner to reduce the impact force when the substrate thickness is less than a selected value.

7 Claims, 2 Drawing Sheets

PRINTER PAPER THICKNESS DETECTOR

BACKGROUND OF THE INVENTION

1. Field of the Invention

The present invention relates generally to the control of the printer hammer of an impact printer.

Impact printers generally operate to print characters on a printing substrate by the forceful striking of characters in relief against the substrate via an inked ribbon under the action of a printer hammer. The printer hammer is generally driven by an actuating current whose magnitude determines the impact force. Typically, the magnitude of the hammer actuating current is set to assure a good imprint on a relatively thick substrate, particularly a substrate composed of several sheets of paper which are to be simultaneously printed with the aid of carbon paper.

A forceful striking will not pose a significant threat to the structural integrity of the hammer if the substrate is sufficiently thick to absorb the impact. However, when a relatively thin substrate, e.g. one or two sheets, is being printed on, the substrate may not be sufficiently thick to satisfactorily absorb the impact forces. Then, the hammer may chip or break.

The actuating current for the hammer is normally set at a maximum level in order to adequately drive the keys to print on thick substrates such as multiple carbon copies or the like. In these instances sufficient current must be supplied since the operator is unable to predict beforehand the thickness of the substrate.

It is therefore a primary object of the present invention to protect such printer hammers from excessively forceful driving impact when printing is being effected on a thin substrate.

SUMMARY OF THE INVENTION

The above and other objects are achieved, according to the present invention, in a printer having a printing mechanism for placing printed matter on a substrate, the printing mechanism including character printing elements and an electrically driven hammer unit which is connected to receive an actuating current and is operative for causing the printing elements to print characters on the substrate by impacting against the elements with an impact force dependent on the magnitude of the actuating current, by the improvement comprising:

substrate thickness monitoring means mounted in the printer for monitoring the thickness of a substrate disposed to be printed upon by the mechanism and for producing a electrical output signal indicative of the substrate thickness; and actuating current control means connected to receive the output signal from the monitoring means and to control the actuating current in a manner to reduce the impact force when the substrate thickness is less than a selected value.

DESCRIPTION OF THE PREFERRED EMBODIMENTS

Figure 2:
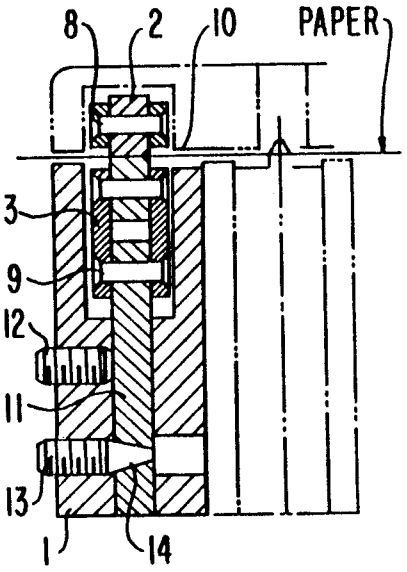
FIG. 2 is a cross-sectional view taken along line A—A of FIG. 1.
Figure 1:
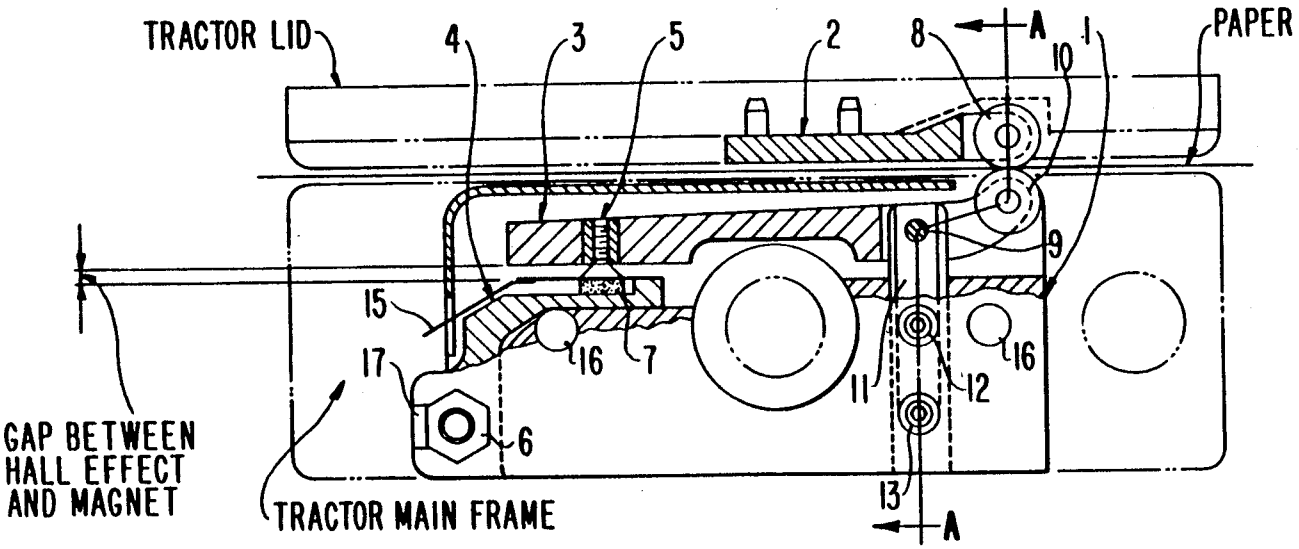
FIG. 1 is a side elevational view, partly in cross section, of a preferred embodiment of a substrate thickness monitor according to the present invention.

Referring to FIGS. 1 and 2, the substrate thickness monitoring device according to the present invention is preferably mounted on one tractor of a printer, the tractor being mounted downstream of the printing location, with respect to the direction of paper feed, and being located along one side of the paper travel path, a second tractor being normally mounted along the other side of the paper travel path. In the illustrated embodiment, paper extends substantially horizontally while traveling through the tractor.

FIGS. 1 and 2 show the tractor main frame and tractor lid in phantom lines and FIG. 1 shows two circular passages in the tractor main frame for the passage of a support rod and a tractor drive rod, which are conventional in printers.

The substrate thickness monitoring device includes a base member 1 which is fixed to the tractor main frame and an upper member 2 which is fixed to the tractor lid. A lever arm 3 is pivotally mounted to base 1 and a holder 4 carrying a Hall effect device 7 is fixed to base member 1. Fixation of holder 4 to base member 1 is preferably effected by means of a threaded fastener 6 which is installed horizontally and is thus readily accessible from the open region at the interior of the printer, thereby facilitating removal and replacement of holder 4.

Arm 3 carries a small permanent magnet 5 which is mounted in a threaded plug screwed into a threaded passage in arm 3. Rotation of the threaded plug permits the gap present between the lower end of magnet 5 and the active surface of Hall effect device 7 to be adjusted before paper is introduced into the tractor.

Upper member 2 carries an upper roller 8 whose axis of rotation is fixed relative to the tractor lid, and thus relative to the paper feed path when the printer is in operation, roller 8 serving to engage the upper surface of the paper being fed through the tractor. Arm 3 is pivoted to base member 1 at a pivot bearing 9 and carries, at the side remote from magnet 5, a second roller 10 which will contact the lower surface of the paper whose thickness is to be sensed.

Pivot bearing 9 is supported by a post 11 which fits into a groove in base member 1 and is locked in position by a set screw 12. In addition, the vertical position of post 11 within base member 1 is determined by the position of a threaded pin 13 having a tapered end 14 which bears against the lower end of post 11. By advancing pin 13 into or out of its associated threaded bore in base member 1, and with set screw 12 loosened, it is possible to effect a precise adjustment of the vertical position of post 11 and thus of pivot bearing 9. Normally, this will be done during initial set-up in order to establish the spacing, or at least approximate spacing, between magnet 5 and Hall effect device 7 before paper is introduced into the tractor. When the desired position is achieved, set screw 12 is tightened down.

When paper, which may be composed of one or more sheets, and which constitutes the substrate mentioned earlier herein, is advanced by the tractor between rollers 8 and 10, roller 10 is deflected downwardly, thereby pivoting arm 3 in a manner to increase the size of the gap between magnet 5 and hall effect device 7. According to one aspect of the invention, the distance between pivot bearing 9 and magnet 5 is several times greater than the distance between pivot bearing 9 and the pivot axis of roller 10. This causes changes in the spacing between rollers 8 and 10 to be amplified at magnet 5 and Hall effect device 7 and thus enables the linear response range of Hall effect device 7 to be more fully utilized.

Electrical connections for Hall effect device 7 are made via leads 15.

Base member 1 is mounted to the tractor main frame via suitable bolts extending through openings 16.

As is the case for bolt 6 of holder 4, set screw 12 and pin 13 are accessible from the side at the interior of printer 14, so that adjustment of the vertical position of post 11 can be easily effected after base member 1 has been mounted on the tractor main frame. Magnet 5 can be easily accessed for adjustment or replacement simply by lifting the tractor lid. Access to Hall effect device 7 can be easily attained, when the tractor lid is lifted, simply by pivoting arm 3 to raise the end carrying magnet 5. To provide a sufficient pivoting range, arm 3 is formed to curve upwardly in the region between pivot point 9 and roller 10.

It will be noted that bolt 6 is installed in an open slot 17 formed in base member 1. This permits removal of holder 4 simply by loosening bolt 6 and then sliding the holder, with the bolt remaining connected thereto, to the left, with respect to the view of FIG. 1.

According to a preferred embodiment of the invention, the Hall effect device 7 is constituted by a model SS94A switch marketed by Micro Switch, a Honeywell Division, of Orange, CA. It was found that satisfactory operation was obtained by adjusting the position of magnet 5 so that the gap between the magnet and Hall effect device 7 has a value of the order of 0.04 to 0.043 inch when rollers 8 and 10 are spaced apart by a distance corresponding to the thickness threshold between a thick substrate and a thin substrate. This gap spacing corresponds essentially to the transition of the Hall effect operating characteristic from its saturation region to its active, or linear, region. Of course, the initial gap dimension selected depends on the strength of magnet 5 and the type of Hall effect device employed.

The selection of a value of 3.5 for the ratio of the distance of magnet 5 from pivot bearing 9 to the distance of the axis of roller 10 from bearing 9 has been found to permit Hall effect device 7 to operate over its linear range for essentially all anticipated substrate thicknesses.

Figure 3:
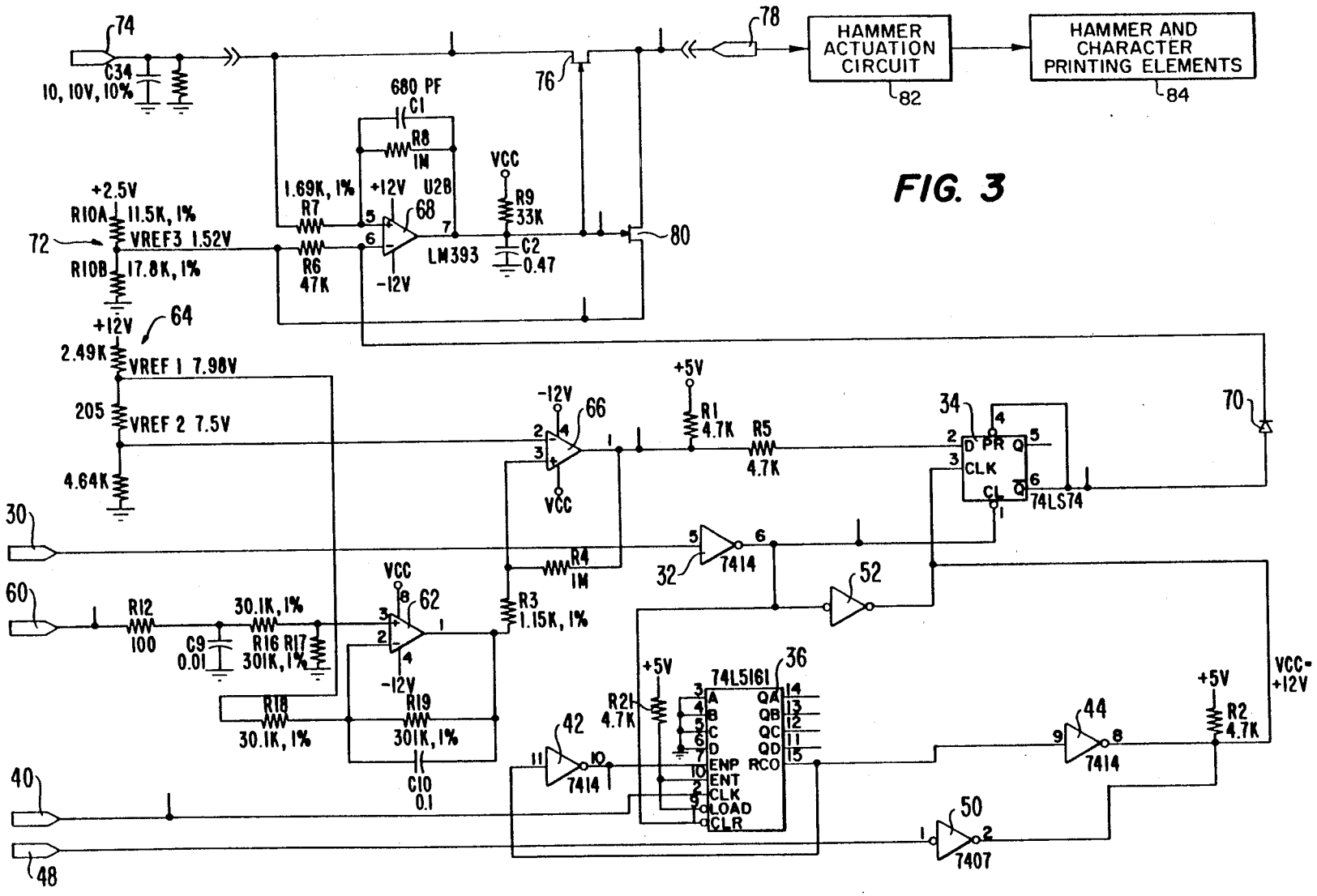
FIG. 3 is a circuit diagram of a preferred embodiment of an actuating current control circuit according to the invention.

FIG. 3 shows a hammer current control circuit according to an embodiment of the present invention. This circuit can be added to the circuit already provided in a printer to control its operation. Terminal 30 is connected to the existing circuitry to obtain a "bandrun" signal, which is a binary signal indicating whether the character bands of the printer are running. Before a new substrate can be fed into a printer, the character bands must be turned off and then turned on again to begin advancing the new substrate. Thus, the introduction of a new substrate whose thickness is to be monitored is always accompanied by a defined change in the value of the signal at terminal 30. The direction of this change is determined by circuit design considerations and is not in any way critical to the operation of the circuit according to the present invention. The bandrun output signal on terminal 30 is applied via a conductor to the input of an inverter buffer 32. Inverter buffer 32 operates to invert the signal provided thereto and the inverted bandrun signal output from buffer 32 is supplied to the "clear" inputs (CL,CLR) of a flip flop 34 and a counter 36.

After initiation of a bandrun signal, and at the end of a subsequent line print operation, the printer tractor is driven by a stepping motor, which may be a three-phase motor. The pulses of one of the phases of this motor are supplied to a terminal 40 which is connected to the clock input (CLK) of counter 36 When the stepping motor is placed into operation and the clear input (CLR) of counter 36 is deactuated, which will occur when a bandrun signal appears, counter 36 counts the motor phase pulses being received by terminal 40. When a predetermined number of pulses has been counted, an overflow, or carry, signal will appear at the counter overflow output (RCO). By way of example, counter 36 can be a four-bit counter which will overflow when 16 pulses have been counted, corresponding to a paper advance equal to four printing lines.

The counter overflow output (RCO) is connected to the input of an inverter 42 whose output is connected to a counter input (ENP) which performs a counter control such that the presence of an overflow signal at output RCO latches counter 36 in its existing state, in which it will remain until a "clear" signal is received at its clear input (CLR).

The counter overflow output (RCO) is additionally connected to an inverter buffer 44 which operates to invert the signal provided thereto, and the inverted signal output therefrom is supplied to the clock input (CLK) of flip flop 34.

A clock signal present within the existing printer control circuitry is supplied to a terminal 48 and is conducted from that terminal via a buffer 50 to the clock input (CLK) of flip flop 34. In addition, the output of inverter 32 is conducted to the clock input (CLK) of flip flop 34 via a further buffer 52.

The output signals from inverter 44 and buffer 52 enable the transmission of clock pulses from terminal 48 to the clock input (CLK) of flip flop 34 only when a bandrun signal is present at terminal 30 and an overflow signal is not present at output RCO of counter 36. Each clock pulse applied to input CLK of flip flop 34 causes the flip flop to read the signal present at its D input. That signal is representative of substrate thickness, as will now be described.

As a substrate is being advanced by the printer tractors, its thickness is being continuously monitored by the sensor mounted at one of the tractors. The sensor output signal, which, according to the present invention, is an analog voltage having an amplitude inversely proportional to substrate thickness, is delivered to a terminal 60 which is connected to the noninverting input of a differential amplifier 62. The inverting input of differential amplifier 62 is connected to a selected tap of a voltage divider 64 to receive a selected reference voltage. The reference voltage is selected to have an amplitude less than the amplitude of the sensor voltage for all substrate thicknesses which would be expected and differential amplifier 62 produces an amplified version of the difference between the sensor output voltage and the reference voltage. Thus the output voltage of differential amplifier 62 is representative of substrate thickness but the slope of its variation with changes in substrate thickness is greater than that of the sensor voltage at terminal 60. For example, if differential amplifier 62 has an effective gain of 10, a variation of 0.75V at terminal 60 will produce a variation of 7.5V at the output of differential amplifier 62.

The output voltage of differential amplifier 62 is conducted to the noninverting input of a further comparator 66 whose inverting input is connected to receive a second selected reference voltage from divider 64 and whose output is connected to the D input of flip flop 34. The second selected reference voltage is given a value equal to that value of the voltage at the output of differential amplifier 62 which corresponds to the threshold between a "thick" substrate and a "thin" substrate.

If the voltage applied to the noninverting input of comparator 66 is lower than the voltage applied the inverting input of that comparator, indicating that a thick substrate is being sensed, the output voltage from comparator 66 will have a value corresponding to a logic L (low). Conversely, when the voltage at the noninverting input of comparator 66 is higher than that at the inverting input, indicating that a thin substrate is being sensed, the output voltage of comparator 66 assumes a value corresponding to a logic H (high).

The output voltage from comparator 66 is applied to the D input of flip flop 34 and is sensed by flip flop 4 during each clock pulse applied to input CLK.

Prior to the start of a monitoring period, flip flop 3 has been reset by a signal at its input CL, so that the complementary output $\overline{Q}$ of flip flop 34 is in the logic H state. This output state will remain unless and until a signal corresponding to the H state appears at input D in time coincidence with a clock pulse. If, at any time during the monitoring period, a logic H does appear at flip flop input D, indicating that a thin substrate has been at least temporarily sensed, the output signal at output $\overline{Q}$ will change to the L state and flip flop 34 will be latched in that state by the resulting signal applied to its latching input PR.

At the end of a monitoring period, which will usually be determined by the appearance of a carry signal at output RCO of counter 36, the delivery of clock pulse signals to flip flop 34 will be terminated and flip flop 4 will then remain in its existing state. Flip flop 34 will be reset when the bandrun signal appearing at terminal 30 is turned off.

The $\overline{Q}$ output of flip flop 34 is connected to the inverting input of a further comparator 68 via a diode 70. The inverting input of comparator 68 is additionally connected to a voltage divider 72 which supplies a third reference voltage VREF 3 having a value selected to correspond to the maximum voltage to be supplied to the hammer actuating mechanism if a thin substrate is being sensed. The noninverting input of comparator 68 is connected to a terminal 74 which receives the hammer actuating voltage normally set in the printer and suitable for printing on thick substrates.

The output of comparator 68 is connected to the gate of a first JFET 76 providing a switchable conductive path between terminal 74 and circuit output terminal 78, and to the gate of a second JFET 80 providing a switchable conductive path between VREF 3 and circuit output terminal 78. As shown, in the illustrated embodiment of the invention, FET 76 is a p-type device and FET 80 is an n-type device.

If output $\overline{Q}$ of flip flop 34 is in the L state, which means that a thin substrate indication has been produced, the voltage at the inverting input of comparator 68 will be equal to VREF 3. If the voltage applied to the noninverting input of comparator 68, which is derived from terminal 74, exceeds the voltage at the inverting input, comparator 68 will produce an output signal which renders FET 76 nonconductive and FET 80 conductive so that it is VREF 3 which is applied to output terminal 78. The magnitude of VREF 3 is selected to cause the hammer to produce an impact force which will be compatible with a thin substrate.

If, however, a thick substrate has been detected during the preceding monitoring period, which means that the output $\overline{Q}$ of flip flop 34 is in the H state, the inverting input of comparator 68 will be set to a level which is higher than the highest voltage which can be set at terminal 74. In this case, the output of comparator 68 will have a value such that FET 76 is rendered conductive and FET 80 is rendered nonconductive. In this case, the voltage of terminal 74 is conducted to output terminal 78.

Thus, if a thin substrate has been sensed, the voltage applied to output 78 will be no higher than VREF 3. It can be lower than that value if a lower voltage is being applied at terminal 74. Conversely, if a thick substrate has been detected, the voltage at terminal 78 is determined by that applied at terminal 74.

The voltage appearing at terminal 78 is then supplied to the hammer actuation 82 which forms part of the existing device and will not be described here, to control the hammer impact force applied by a hammer on character printing elements, collectively shown at 84.

It will be noted that the circuit according to the present invention will produce an indication that a thick substrate is present only if, during the monitoring period, the signal at terminal 60 always has a value representative of a thick substrate. If, at any time during the monitoring period, this signal assumes a value indicative of a thin substrate, the illustrated circuit will supply to comparator 68 a signal which assures that the impact force produced by the hammer will be no greater than that associated with the selected value of VREF 3. This control scheme is employed to take into account the fact that when a substrate is monitored close to its feed perforations, a thick substrate indication can be produced at least temporarily by the portions of the substrate adjacent the perforations.

FIG. 3 illustrates a complete operative circuit including a number of passive elements which have not been described in detail and includes exemplary values for these passive components. Since, however, those components are associated only with structural details of the circuit and involve matters of routine in the art, it is not believed that a detailed description of those components is necessary. It will be appreciated that the exemplary component and voltage values appearing in FIG. 3 are included only by way of example and can be varied in operative embodiments of the invention.

We claim:

1. In a printer having a printing mechanism for placing printed matter on a substrate, the printing mechanism including character printing elements and an electrically driven hammer unit which is connected to receive an actuating current and is operative for causing the printing elements to print characters on the substrate by impacting against the elements with an impact force dependent on the magnitude of the actuating current, the improvement comprising:

substrate thickness monitoring means disposed in the printer for monitoring the thickness of a substrate disposed to be printed upon by the mechanism and for producing an electrical output signal indicative of the substrate thickness; and actuating current control means connected to receive the output signal from said monitoring means and to control the actuating current in a manner to reduce the impact force when the substrate thickness is less than a selected value;

wherein said actuating current control means comprise a timer for timing a predetermined time period following the introduction of a new substrate into the printer and circuit means for detecting the electrical output signal during the predetermined time period.

2. Apparatus as defined in claim 1 wherein said actuating current control means are operative to reduce the impact force when the electrical output signal assumes a value indicative of a substrate thickness less than the selected value at any moment during the selected time period.

3. In a printer having a printing mechanism for placing printed matter on a substrate, the printing mechanism including character printing elements and an electrically driven hammer unit which is connected to receive an actuating current and is operative for causing the printing elements to print characters on the substrate by impacting against the elements with an impact force dependent on the magnitude of the actuating current, the improvement comprising:

substrate thickness monitoring means disposed in the printer for monitoring the thickness of a substrate disposed to be printed upon by the mechanism and for producing an electrical output signal indicative of the substrate thickness; and actuating current control means connected to receive the output signal from said monitoring means and to control the actuating current in a manner to reduce the impact force when the substrate thickness is less than selected value:

wherein the printer is operable to receive a substrate, and wherein the actuating current control means comprises:

timing means for timing a predetermined period following the receipt by the printer of a substrate; and receiving means, responsive to the timing means, for receiving the output signal from the monitoring means upon the output signal being provided during the predetermined period.

4. In a printer having a print hammer operable to be actuated in response to an actuation signal for printing on a substrate, a control device for providing at an output terminal an actuation signal having one of a first value for printing on a thick substrate and a second value for printing on a thin substrate, the control device comprising:

a first input operable to receive an actuation signal having a first value;

a second input operable to receive an actuation signal having a second value;

a switching device operable to selectively and operatively connect the first and second inputs, individually, with the output terminal;

sensing means for sensing the thickness of the substrate and for providing a thickness signal having a value corresponding to the sensed thickness;

comparing means, operatively connected with the sensing means, for comparing the value of the thickness signal with a predetermined value and for providing a first output signal upon the thickness signal value being less than the predetermined value and a second output signal upon the thickness signal value being greater than the predetermined value; and switching control means for controlling the switching device, the switching control means being responsive to the output signal of the comparing means for controlling the switching device to operatively connect the first input with the output terminal in response to the first output signal of the comparing means and to operatively connect the second input with the output terminal in response to the second output signal of the comparing means;

wherein the printer is operable to receive a substrate, the control device further comprising:

detecting means for detecting the receipt by the printer of a substrate; and timing means, responsive to the detecting means, for timing a predetermined period following the detection of the receipt of a substrate;

wherein the switching control means is operatively connected with the timing means and includes means for controlling the switching device during the predetermined time period and means for maintaining, following the predetermined time period, the operative connections selected by the switching device during the predetermined time period.

5. In a printer having means for receiving a substrate to be printed on, printing elements, and a hammer unit responsive to an actuating current for impacting against the printing elements with an impact force dependent on the magnitude of the actuating current, the improvement comprising:

substrate thickness monitoring means for monitoring the thickness of a substrate and for producing an output signal indicative of the substrate thickness; and actuating current control means, responsive to the output signal of said substrate thickness monitoring means, for controlling the actuating current in a manner to reduce the impact force when the substrate thickness is less than a predetermined value;

wherein said actuating current control means comprise a timer for timing a predetermined time period following the introduction of a new substrate into the printer and circuit means for detecting the output signal during the predetermined time period.

6. Apparatus as claimed in claim 5, wherein said circuit means comprises timing means for timing the lapse of the predetermined time period, the time period beginning upon the introduction of the substrate to the printer, and wherein said actuating current control means comprises means for setting the magnitude of the actuating current prior to the lapse of the predetermined time period and for maintaining the set actuating current magnitude following the lapse of the predetermined time period.

7. Apparatus as claimed in claim 5, wherein said circuit means comprises:

timing means for timing a predetermined time period following the receipt by the printer of the substrate; and signal receiving means, responsive to said timing means, for receiving the output signal from said monitoring means upon the output signal being provided during the predetermined time period.

* * * * *